US006525454B2

(12) United States Patent
Calon et al.

(10) Patent No.: US 6,525,454 B2
(45) Date of Patent: Feb. 25, 2003

(54) ELECTRIC LAMP

(75) Inventors: Georges Marie Calon, Eindhoven (NL); Godefridus Nicolaas Maria Verspaget, Eindhoven (NL)

(73) Assignee: Koninklijke Philips Electronics N.V. (NL)

( * ) Notice: Subject to any disclaimer, the term of this patent is extended or adjusted under 35 U.S.C. 154(b) by 112 days.

(21) Appl. No.: 09/811,646

(22) Filed: Mar. 19, 2001

(65) Prior Publication Data

US 2001/0038262 A1 Nov. 8, 2001

(30) Foreign Application Priority Data

Mar. 22, 2000 (EP) ..... 00201034

(51) Int. Cl.[7] ..... H01J 5/50

(52) U.S. Cl. ..... 313/318.03; 313/318.01; 313/318.09

(58) Field of Search ..... 313/317, 318.01, 313/318.03, 318.04, 318.05, 318.06, 318.12, 623; 439/611, 613, 615, 436, 439, 440, 441

(56) References Cited

U.S. PATENT DOCUMENTS 4,015,157 A * 3/1977 Roller et al. ..... 313/25
5,057,735 A * 10/1991 Zalar et al. ..... 313/113
5,275,620 A * 1/1994 Darby et al. ..... 439/441
5,281,889 A * 1/1994 Fields et al. ..... 313/113
5,659,221 A * 8/1997 Coushaine et al. .... 313/318.01
5,698,936 A * 12/1997 Marien et al. ..... 313/113
5,747,919 A * 5/1998 Gandhi et al. ..... 313/318.01
5,945,776 A * 8/1999 Koster et al. ..... 313/113
6,080,008 A * 6/2000 Frantz ..... 439/441
6,128,181 A * 10/2000 Higami et al. ..... 174/252
6,147,444 A * 11/2000 Gallant et al. ..... 313/318.01
6,163,102 A * 12/2000 Tucker et al. ..... 313/113
6,262,534 B1 * 7/2001 Johnson et al. ..... 313/26

FOREIGN PATENT DOCUMENTS

EP 0758486 B1 2/1997 ..... H01K/1/46

* cited by examiner

*Primary Examiner*—David Martin
*Assistant Examiner*—Thanh S. Phan
(74) *Attorney, Agent, or Firm*—Dicran Halajian; Frank Keegan

(57) ABSTRACT

The electric lamp has a light source (20) in an envelope (21). The light source (20) is secured in a body (1) by means of an insulator body (40) in which current connectors (43) are integrated and which is present in a socket (10) of the reflector lamp. The socket (10) is mechanically connected to the neck portion (5) of the body (1). The integrated insulator/current connector body (40, 43) enables electrical contacting, fixation, and mechanical adjustment of the light source (20) in the body (1). For reliable electrical contacting, the current connector (43) includes cylindrical part (60) with scraping edges (63).

9 Claims, 2 Drawing Sheets

ELECTRIC LAMP

FIELD OF THE INVENTION

The invention relates to an electric lamp comprising:

an envelope with a neck and a light source;

a lamp cap provided with contacts, which lamp cap is fixed around a free end portion of the neck; and current conductors which are passed from the light source through the free end portion of the neck and are electrically connected to the contacts of the lamp cap.

BACKGROUND OF THE INVENTION

Such an electric lamp is known from EP-0 758 486. The known lamp is a reflector lamp with a light emission window, the envelope being internally partly reflectorized. The light source is placed in the known lamp in a lamp vessel which is mechanically secured in a plate. The plate and the lamp. vessel are fixed in the neck of the envelope by means of cement. The current conductors passed through the free end portion of the neck issue into the lamp cap, which is hollow. The lamp cap has a screwthread-type contact around an axis and a central electrical contact situated on the axis. The current conductors of the light source are flexible and are guided towards the contacts in the hollow lamp cap, for example in that they are bent, and are fixed to these contacts by means of welding or soldering. It is a disadvantage of the known lamp that achieving the electrical contact between the current conductors of the light source and the contacts of the lamp cap by means of welding or soldering involves a comparatively cumbersome and difficult process. This is rendered more difficult in part by the size of the light source, which leaves comparatively little space for achieving the contact. In addition, welding/soldering is a process which is comparatively hard on the environment. Undesirable bending of the flexible current conductors may arise as a result of external forces, such as shocks and impacts, because the current conductors in the hollow lamp cap are not screened from one another in the known lamp. As a result, the known lamp has the additional disadvantage that there is a comparatively high risk of short-circuits caused by the current conductors approaching one another too closely or even touching one another owing to their undesired bending.

SUMMARY OF THE INVENTION

It is an object of the invention to provide an electric lamp of the kind described in the opening paragraph which has a comparatively safe construction and which renders possible a simple assembly of the lamp.

According to the invention, this object is achieved in that an insulator body provided with connection conductors is accommodated in the lamp cap for the electrical connection of the current conductors to the contacts of the lamp cap, at least one of the connection conductors comprises an end portion, which end portion comprises a cylindrical portion of a given shape, which defines a cylinder axis, said cylindrical portion comprising:

a slit extending parallel to the cylinder axis and bounded by two cylinder edges extending parallel to the cylinder axis and spaced apart from one another by a slit spacing S for retaining the current conductor, and an opening which is provided in the cylindrical portion, which lies substantially opposite the slit, and through which the current conductor can be passed.

The connection conductors are passed through the insulator body through respective channels. The channels are separate from one another. The current conductors and the connection conductors electrically connected thereto through the insulator body are thus mechanically screened off from one another. This renders the lamp comparatively safe because the risk of short-circuits caused by the current conductors touching each other is reduced. The channels in the insulator body each comprise a recess. The end portion of the connection conductor extends into this recess, while a further end portion of the connection conductor is electrically connected to the contact of the lamp cap, for example by means of a resilient contact or, for example, in that the further end portion is clamped in between the insulator body and the lamp cap. The resilient contact has the advantage that the electrical connection between the connection conductor and the contact on the lamp cap can be achieved without welding or soldering. This simplifies the lamp assembling process and is less hard on the environment. The current conductor is inserted as far as possible into the recess, with the result that the current conductor also extends through the opening and the slit of the cylindrical portion of the connection conductor, thus making electrical contact therewith. The electrical contact between the current conductor and the contact on the lamp cap via the connection conductor is thus achieved in a comparatively simple manner. This further simplifies the lamp assembling process.

The connection conductor with its cylindrical portion has a simple shape which can be realized in a comparatively simple and inexpensive manner, for example by stamping out of the opening and deformation of metal plating, whereby the cylindrical portion is formed and the cylinder edges are brought to a slit distance S from one another. Usually, the opening is elongate and has a minimum cross-section D which is greater than the slit width S. It is also true here that it is desirable for electrical contacting that the slit width S should be smaller than a smallest diameter of the current conductor. Such a current conductor allows of comparatively wide tolerances in dimensioning and mutual interspacing of the current conductors, so that a reliable electrical contacting can be realized in a simple manner.

In an embodiment, the end portion is a clamping/scraping contact. An inadvertent retraction from the slit of the current conductor passed through the slit is counteracted by the clamping/scraping contact, for example a contact which has a clamping, hooking, and/or abrasive effect on the current conductor introduced therein. The risk of breaking of the electrical contact with the contact on the lamp cap is reduced thereby.

In a further embodiment, the cylinder edge comprises a tag which faces away from the opening. A cylinder edge having such a shape facilitates the insertion of the current conductor into the slit. In addition, a cylinder edge having such a shape provides an improved electrical contacting with the current conductor passed through the slit. If the tag has a hooking effect, an improved hooking action on a current conductor passed through the slit is obtained. The removal from the slit of this current conductor is rendered more difficult thereby, and the risk of breaking of the electrical contact with the contact on the lamp cap is further reduced.

In a favorable embodiment of the electric lamp, the cylindrical portion is resilient. A permanent, satisfactory electrical contacting between the current conductor and the connection conductor is realized in that the cylinder edges bear on the current conductor under spring force. A yet further improved clamping, scraping, and/or hooking action of the cylinder on a current conductor passed through the slit is obtained thereby. In addition, it is even more difficult to remove the current conductor from the slit, and the risk of breaking of the electrical contacting with the contact on the lamp cap is further reduced. The resilient cylindrical portion may be obtained in a simple manner in that the cylindrical portion is manufactured from materials suitable for the purpose, for example from spring steel, and through suitable dimensions of the cylindrical portion. The dimensions of the cylindrical portion suitable for adjusting the spring force with which the cylinder edges bear on the current conductor are, inter alia, the cylinder length $L_c$, the thickness of the material from which the cylinder is manufactured, the dimension of the opening in axial direction $L_o$, and the maximum dimension H of the cylindrical portion in relation to the width $B_c$ of the cylindrical portion. It is favorable when H is at most $0.25 \times B_c$. At a higher $H/B_c$ ratio, there is an increased risk of the cylindrical portion having an insufficient resilient effect, so that the cylinder edges bear on the current conductor with a too small spring force.

In a further embodiment, the envelope is internally reflectorized between the neck and the light emission window. The reflector body thus formed has a concave, beam-forming portion with an optical center and is present between the neck and the light emission window. The light source is arranged axially in the optical center. The light generated by the light source can be formed into a beam and directed in a simple manner by means of the reflector body in the reflector lamp thus obtained.

In an embodiment, the insulator body is made of synthetic resin, porcelain, glass, or ceramic material. It is favorable for the use of the lamp at comparatively high temperatures if the insulator body is made of porcelain, glass, or a ceramic material because of the good temperature resistance of these materials. If the lamp is to be operated at comparatively low temperatures, the insulator body is preferably made of a synthetic resin, because an insulator body of synthetic resin can be manufactured in a comparatively simple and inexpensive manner.

It is favorable for achieving a reproducible position of the insulator body in the lamp cap when the insulator body is provided with a recess which cooperates with the lamp cap. The insulator body is retained in the lamp cap in that the lamp cap is indented into said recess. The insulator body and the lamp cap are locked against mutual rotation about the axis thereby. Such a rotation may occur as a result of torques, for example during screwing of the lamp into or from a luminaire. In addition, the assembling process of the electric lamp is further simplified thereby because an additional position definition of the insulator body in the lamp cap with respect to the light source is avoided. This also reduces the risk of short-circuits between the current conductors in the lamp cap owing to a rotation of the insulator body with respect to the lamp cap. Since the insulator body and the lamp cap are locked against mutual rotation, a permanent, secure clamping-in of the further end portion between the insulator part and the lamp cap is realized at the same time. The risk of breaking of an electrical contact between the lamp cap and the connection conductor is thus reduced.

In the known lamp, the light source is aligned and fixed in the neck of the envelope by means of cement, for example lamp cement. It is disadvantageous, however, for a reflector lamp that cement evolves volatile ingredients which impair the reflecting power of the reflector body, also after curing of the cement. In the lamp according to the invention, the use of cement for this purpose is avoided in that a reproducible fixed position of the insulator body in the lamp cap is achieved in that the insulator body is accommodated in the lamp cap with narrow fit. The insulator body may have, for example, a screwthread-type surface for this purpose, in which case the insulator body can be turned into the lamp cap, which has a screwthread-type contact. The fact that the insulator body is fixed in the lamp cap renders it possible to secure the light source aligned in the reflector lamp in cooperation with the clamping/fixing end portion. A yet further simplification in the lamp assembling process is also achieved thereby.

In a further favorable embodiment of the electric lamp, at least one connection conductor at the same time comprises one contact of the lamp cap. Since a separate welding or soldering operation for electrically connecting the connection conductor to the contact of the lamp cap is avoided, the lamp assembling process is yet further simplified, and the environment is further spared. In addition, a yet more reliable electrical contact is achieved in this way.

The light source may be an incandescent body, possibly in an atmosphere comprising halogen, or a discharge path between electrodes in an ionizable medium, for example metal halides in rare gas, possible with mercury. The light source may be provided in a lamp vessel made of glass, for example of hard glass or glass having an $SiO_2$ content of at least 95% by weight such as, for example, quartz glass, or of monocrystalline or polycrystalline material such as, for example, translucent aluminum oxide. The lamp vessel may be surrounded by an outer bulb.

The reflector lamp may be provided with a light-transmitting cover which is fastened to the reflector body and which closes off the light emission window.

BRIEF DESCRIPTION OF THE DRAWINGS

An embodiment of the lamp according to the invention is shown in the drawing, in which.

DETAILED DESCRIPTION OF THE INVENTION

Figure 1:
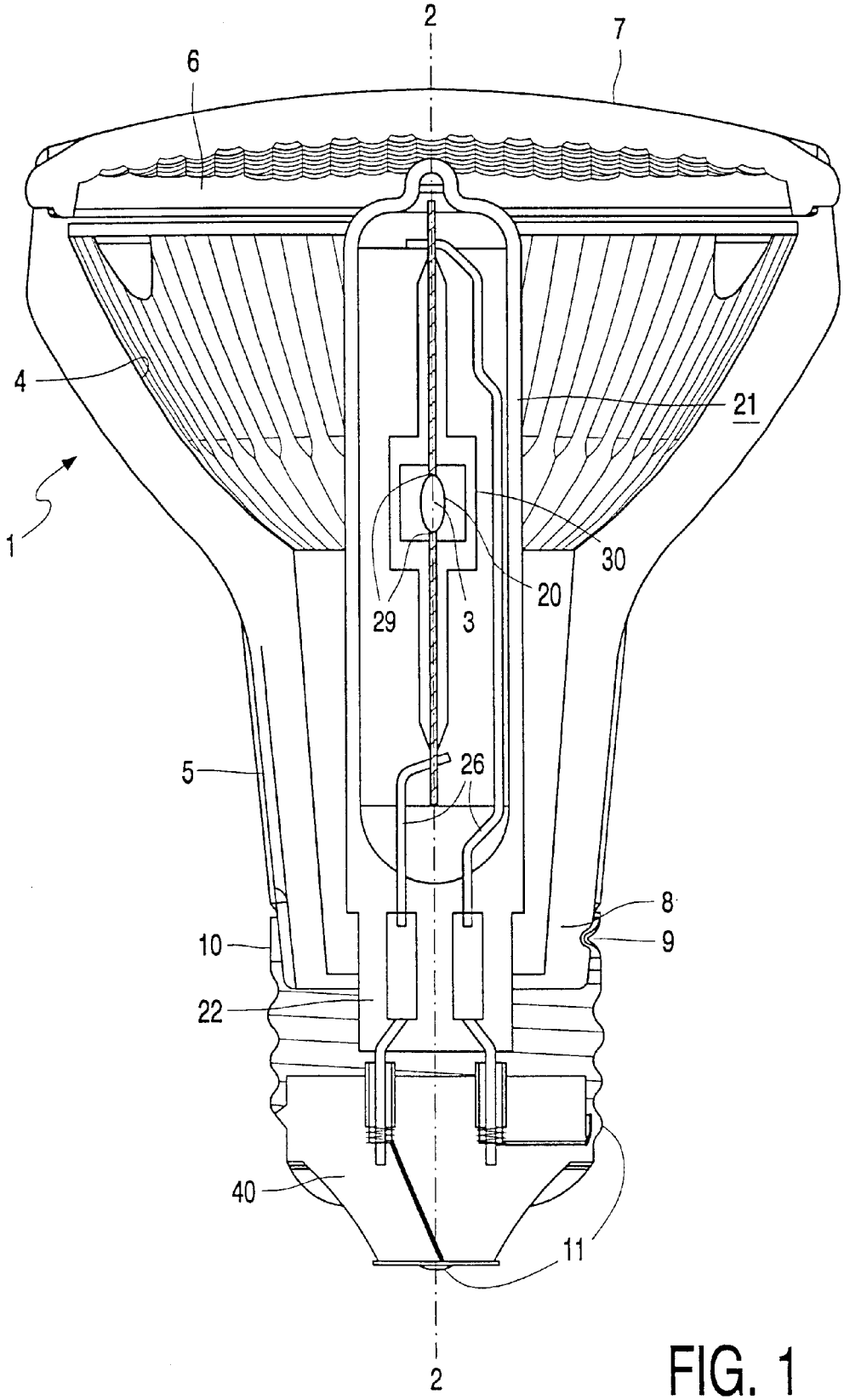
FIG. 1 shows a lamp in axial sectional view with the lamp cap broken away.

In FIG. 1, the electric lamp is a reflector lamp with an envelope 1 of a light-transmitting material, molded glass in the Figure, which is internally partly reflectorized. The reflector body thus obtained has a concave light-concentrating portion 4 between a neck 5 and a light emission window 6, and an axis 2 and an optical center 3. The reflectorizing portion of the reflector body may be a metal layer, for example made of silver or aluminum, or alternatively an interference filter. The light-concentrating portion is the body of revolution of a branch of a parabola which has been pivoted towards the axis with its focus in the optical center. A light-transmitting glass cover 7 is fastened to the reflector body, by means of epoxy resin in the Figure, thus closing off the light emission window 6. A lamp cap 10 provided with contacts 11 is fixed around a free end portion 8 of the neck in that it has been indented into recesses 9. Alternatively, however, the lamp cap may be fixed by means of an adhesive, for example a glue. A light source 20 is axially positioned in the optical center 3 in an outer bulb 21 which is closed in a gastight manner, which transmits light, and which is made of quartz glass in the Figure. The light source in the Figure is a discharge path between ends 29 of the current conductors 26 serving as electrodes and accommodated in a ceramic lamp vessel 30 which is filled with rare gas, mercury, and metal halides. Current conductors 26 extend from the light source 20 through a seal 22 of the outer bulb 21 and through the free end portion of the neck 5 to an insulator body 40 accommodated in the lamp cap 10 and are electrically connected to the contacts 11 of the lamp cap 10.

Figure 2:
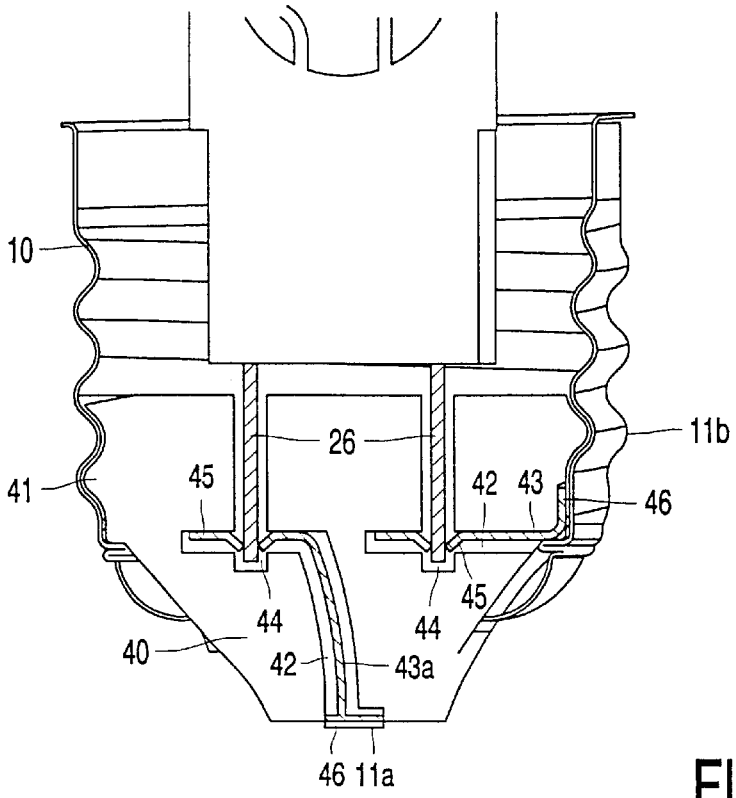
FIG. 2 is an axial sectional view of a detail of the lamp cap of FIG. 1.

FIG. 2 shows the insulator body 40, which is made of ceramic material, for example of aluminum oxide, and which is provided in the lamp cap 10 with narrow fit. The insulator body 40 is for this purpose provided with a screwthread 41 which has a shape mating with that of a screwthread 11*b* of the lamp cap 10. Channels 42, in which respective connection conductors 43 are present, are provided in the insulator body 40. Each channel 42 has a recess 44 into which a first end 45 of the connection conductor projects. The connection conductor comprises a clamping/scraping contact as its end portion 45 in the Figure. The current conductors 26 inserted into the recess 44 are passed through the end portions 45 of the connection conductors 43, 43*a* and are fixed therein by the clamping and scraping action of the clamping/scraping contacts. The connection conductors 43, 43*a* make electrical contact with the contacts 11*a* and 11*b* of the lamp cap 10 by second ends 46. In the Figure, the connection conductor 43*a* comprises the centrally situated contact 11*a* of the lamp cap 10, and the further end portion 46 of the connection conductor 43 is in contact with the contact 11*b* in that it is clamped in between the insulator body 40 and the lamp cap 10.

Figure 3:
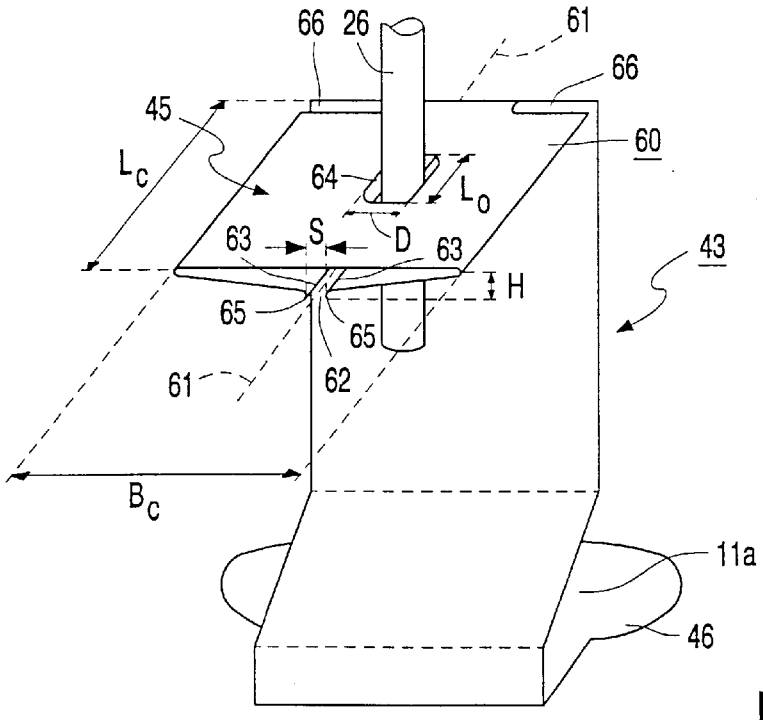
FIG. 3 is a perspective view of a connection conductor of the lamp of FIG. 1.

FIG. 3 shows the connection conductor 43, which comprises the further end portion 46 and the scraping contact 45 as its end portion. The further end portion 46 is constructed so as to form the centrally situated contact 11*a*. The scraping contact 45 comprises a cylindrical portion 60 with a width $B_c$, a length $L_c$, said portion 60 defining a cylinder axis 61. The cylindrical portion 60 comprises a slit 62 which extends parallel to the cylinder axis 61 and which is bounded by two resilient cylinder edges 63 which extend parallel to the cylinder axis and are situated at a slit distance S from one another. The cylindrical portion 60 further comprises an opening 64 which is provided in the cylindrical portion 60 so as to be substantially opposite the slit 62 and which has a length $L_o$ in axial direction and a minimum diameter D of the opening 64 which is greater than the slit width S. In the Figure, $L_o$. is approximately $0.2 \times L_c$. The cylinder edges 63 each have a tag 65 which is directed away from the opening 64. The current conductor 26 is passed first through the opening 64 and then through the slit 62. The tags 65 of the resilient cylinder edges 63 scraping and hooking themselves into the current conductor 26 form a resistance against the current conductor 26 being retracted from the slit 62. To obtain a resilient cylindrical portion 60 with a desired strong compression force of the cylinder edges 63 on the current conductor 26, recesses 66 are provided in the cylindrical portion 60, and the cylindrical portion 60 has a dimension H in the direction of the current conductor 26 which is comparatively small, i.e. approximately $0.10 \times B_c$ in the Figure.

What is claimed is:

1. An electric lamp comprising:

an envelope (1) with a neck (5) and a light source (20);

a lamp cap (10) provided with contacts (11), which lamp cap (10) is fixed around a free end portion (8) of the neck (5); and current conductors (26) which are passed from the light source (20) through the free end portion (8) of the neck (5) and are electrically connected to the contacts (11) of the lamp cap (10), characterized in that an insulator body (40) provided with connection conductors (43) is accommodated in the lamp cap (10) for the electrical connection of the current conductors (26) to the contacts (11) of the lamp cap (10), at least one of the connection conductors (43) comprises an end portion (45), which end portion (45) comprises a cylindrical portion (60) of a given shape which defines a cylinder axis (61), said cylindrical portion (60) comprising:

a slit (62) extending parallel to the cylinder axis (61) and bounded by two cylinder edges (63) extending parallel to the cylinder axis (61) and spaced apart from one another by a slit spacing S for retaining the current conductor (26), and an opening (64) which is provided in the cylindrical portion (60), which lies substantially opposite the slit (62), and through which the current conductor (26) can be passed.

2. An electric lamp as claimed in claim 1, characterized in that the end portion (45) forms a clamping/scraping contact.

3. An electric lamp as claimed in claim 1, characterized in that at least one cylinder edge (63) comprises a tag (65) which faces away from the opening.

4. An electric lamp as claimed in claim 1, characterized in that the cylindrical portion (60) is resilient.

5. An electric lamp as claimed in claim 1, characterized in that the envelope (1) comprises a light emission window (6) and is internally reflectorized between the neck (5) and the light emission window (6).

6. An electric lamp as claimed in claim 1, characterized in that the insulator body (40) is manufactured from a material which is chosen from a group formed by porcelain, glass, ceramic material, and synthetic resin.

7. An electric lamp as claimed in claim 1, characterized in that the insulator body (40) is provided with at least one recess (9) which cooperates with the lamp cap (10) for the purpose of fixing the insulator body (40) in the lamp cap (10) owing to the lamp cap (10) being indented into said recess.

8. An electric lamp as claimed in claim 1, characterized in that the insulator body (40) is provided in the lamp cap (10) with narrow fit for the purpose of fixation of the insulator body (40) in the lamp cap (10).

9. An electric lamp as claimed in claim 1, characterized in that at least one of the connection conductors (43*a*) comprises one contact (11*a*) of the lamp cap.

* * * * *